US006158242A

United States Patent [19]

Lu

[11] Patent Number: 6,158,242

[45] Date of Patent: Dec. 12, 2000

[54] GAS DEHYDRATION METHOD AND APPARATUS

[76] Inventor: Yingzhong Lu, 104 Harland Ct., Oak Ridge, Tenn. 37830

[21] Appl. No.: 09/421,571

[22] Filed: Oct. 20, 1999

[30] Foreign Application Priority Data

Jul. 12, 1999 [CN] China ..... 99109760

[51] Int. Cl.[7] ..... F25J 3/00

[52] U.S. Cl. ..... 62/637; 62/93; 165/61; 96/234; 96/239

[58] Field of Search ..... 62/93, 637, 272, 62/234, 239; 165/61, 921

[56] References Cited

U.S. PATENT DOCUMENTS

| | | | |
|---|---|---|---|
| 2,475,255 | 7/1949 | Rollman | 62/170 |
| 4,490,985 | 1/1985 | Wells | 62/93 X |
| 5,006,138 | 4/1991 | Hewitt | 62/93 X |
| 5,163,981 | 11/1992 | Choi | 55/32 |
| 5,664,426 | 9/1997 | Lu | 62/93 |
| 6,063,163 | 5/2000 | Carmody | 96/234 X |

*Primary Examiner*—William Doerrler
*Assistant Examiner*—Chen-Wen Jiang
*Attorney, Agent, or Firm*—Wolff & Samson

[57] ABSTRACT

The present invention relates to an apparatus and a method for efficiently and cost-effectively removing moisture from pressurized gas stream to any required low level. The invention adopts an irregular matrix of finned pipes to remove the moisture as liquid and solid deposits. Clogging is completely eliminated in the freezer and heat recuperator of this apparatus. The dew-point of the dried gas may be reduced to under −100° F. The method and the apparatus provided by the present invention are universally applicable to the dehydration of all kind of gases, and, hence, can replace all the three major dehydration methods and dehydrators currently in the market, i.e., the solid desiccant absorption, the liquid desiccant absorption, and the refrigeration dehydration. No BTEX pollutant is emitted to the atmosphere when applied to natural gas dehydration. In particular, it provides environmentally benign, self-powered, compact, and low-cost natural gas dehydrators for remote sites where no outside power supply is available.

10 Claims, 8 Drawing Sheets

GAS DEHYDRATION METHOD AND APPARATUS

FILED OF THE INVENTION

The present invention relates to an apparatus and a method for efficiently and cost-effectively removing moisture from all kinds of pressurized gas stream to any required low level. The dew-point of the dried gas may be reduced to under −100° F. The present invention provides a high efficiency and low cost apparatus, and, thus, is universally applicable to the entire gas dehydration market currently dominated by other dehydration processes.

BACKGROUND OF THE INVENTION

Most industrial gases require the removal of moisture before being processed and/or utilized. Three major technologies are currently in use, i.e., absorption with solid desiccants (including molecular sieve), absorption with liquid desiccants, and refrigeration. These technologies have respective merits and shortcomings. As a result, for many decades, each of them only dominated a specific niche of the gas dehydration market. No substantial improvements have been made to significantly affect their respective market shares.

Facing the recent rapid development of modem economy and society, a number of fatal weakness of these relatively obsolete technologies have been revealed, and a revolutionary technology breakthrough is required in the gas dehydration market. For example, the glycol dehydrators that account for over 90% of the natural gas dehydration market emit hazardous air pollutants, notably benzene, toluene, ethyl benzene, and xylene (or BTEX as a whole). The BTEX is now becoming a serious environmental concern in many countries. In the United States of America, regulations for controlling the BTEX emissions are being proposed in many gas-producing states. It is expected that the current type of glycol dehydrators will gradually be phased out early next century. As a result, a number of inventions have been proposed to improve or replace the existing glycol system. One of the examples is the U.S. Pat. No. 5,163,981, "Method and Apparatus for Controlling Discharge of Pollutants from Natural Gas Dehydrators," in which an overhead condenser is added to the exhaust of the reboiler to collect the BTEX as a liquid to eliminate the air pollution. In a newly developed enhanced glycol process, the DRIZO, a solvent extraction sub-system is incorporated to take out the BTEX and water content from the recycled glycol, and, thus, eliminate the air pollution as well as enhance the dew-point depression. All these improvements, however, make the existing glycol system more complex and expensive, and, thus, the market share of the glycol dehydrators will continue to shrink.

The solid desiccant dehydrators do not emit BTEX, and their dew-point depressing capability is also high (e.g., more than 200° F.). However, both the capital and the operational costs are higher. As a result, solid desiccant dehydrators have never entered the main market of natural gas dehydration, i.e., pipeline transportation. Most of the solid desiccant dehydrators are currently used for industrial process gas dehydration, in which very low dew-point are required. Even in these applications, the solid desiccants also cause some operational and maintenance problems. In addition, solid desiccants are not cost-effective for drying low-pressure or high temperature process gases with high specific moisture contents.

The refrigeration method, in principle, can eliminate the BTEX pollution. However, the formation of solid gas dehydrates and ice may clog the gas flow path of the heat exchangers. As a result, the refrigeration dehydrators have never been used in natural gas dehydration,. Presently they are mostly used for industrial compressed air drying, of which the required dew-point is higher than 35° F.

There were several inventions trying to improve the refrigeration dehydrators. One example is the U.S. Pat. No. 2,475,255. "Method of drying gases," in which the moisture is deposited on the surfaces of numerous sub-cooled particles suspending in the gas stream to avoid the clogging of the gas flow. The operability of such a design, however, is questionable. As a result, this patent has never been commercialized.

Recently, in view of the rapid development of modem refrigeration technologies and the popularization of the air conditioning equipment, the BTEX elimination potential of the refrigeration dehydration attracts the attention of the natural gas industry. To mitigate the gas flow path clogging problem, a novel approach was proposed in my previous invention, the U.S. Pat. No. 5,664,426 entitled Regenerative Gas Dehydrator. In that invention, the principle of eddy diffusion in a turbulent gas flow within a multitude of elongate narrow channels has been adopted, so that the solid ice/hydrate deposits become more uniform along the flow path. The clogging process is thus moderated and a reasonable regeneration cycle resulted. A field test prototype has been built, and the commercial demonstration for that patent is now underway. Such a new refrigeration dehydration technology has not only attracted the natural gas industry, but also interested the process gas dehydrator manufacturers who are earnest to replace their current solid desiccant equipment with a better refrigeration process. As a consequence, some changes are going to happen in the U.S. gas dehydration market.

However, the original target of my previous invention was the mitigation of the BTEX pollution of natural gas dehydrators. It may substitute the existing glycol dehydrators in natural gas pipeline transportation market, but it was not intended to compete economically with the solid desiccant dehydrators in the areas of process gas dehydration. Besides, due to the inherent features of the proposed technology, even in the applications to natural gas transportation, difficulties may raise when the inlet natural gas is heavily contaminated, or is under very low or very high pressure. In particular, the said technology is difficult to compete with the glycol dehydrators at remote gas sites where no outside power supply is available. As a result, more substantive technology breakthrough is required for a significant change in the current gas dehydration market.

Accordingly, it is an object of my present invention to provides a more advanced, innovative refrigeration dehydration method to economically achieve very high dew-point depression, and completely eliminate the clogging caused by the solid ice/gas-hydrates deposits (hereafter designated as the "solid deposits" ).

A further object of the present invention is to provide a universally applicable gas dehydrator that can efficiently and economically dehydrate natural gas and all kinds of industrial process gases to the respective specifications.

Still another objective of the present invention is to provide an environmentally benign, self-powered, compact, and low-cost natural gas dehydration system, particularly for remote natural gas well sites where no outside power supply is available.

SUMMARY OF THE INVENTION

With regard to the above and other objects, the present invention provides a non-clogging, high dew-point depression gas dehydration method and apparatus for natural gas and all kinds of industrial process gas dehydration. The dew-point depression range of this refrigeration dehydration system has been greatly extended to cover most applications that are currently dominated by solid desiccant dehydrators, e.g., 200° F.

So, according to the present invention, it provides a method of gas dehydration by flowing the gas stream normal to a chilled finned-pipe matrix with multiple open spaces between the pipes to allow the gas to flow freely, the gas is thus cooled and its moisture content is removed as a liquid and/or solid ice/hydrate deposits on the surfaces of the finned pipes. The solid ice/hydrate particles entrained in the gas are removed in a separator.

In the method described above, the temperature distribution over the fin surfaces varies radially so that the thickness of the ice/hydrate deposit film on the fin surfaces tapers from the fin root towards the fin tip.

In the method described above, the matrix is an irregular matrix, with either a varying-pitch between the pipes in different rows, a varying-geometry (i.e., varying from a parallel to a staggered configuration) among different rows, or both a varying-pitch and a varying-geometry.

The integrated configuration of the invented apparatus compromising:

- a couple of flow-shifting valves connected with a gas inlet pipeline, which periodically reverse the gas flow direction to perform the functions of alternative moisture-freezing/thawing for the continuous removal of moisture from the gas;
- a couple of separator/filters that take out the entrained solid ice/hydrate particles from the cooled gas stream, one end of each is connected with the flow-shifting valves through pipeline;
- a gas pre-heater consisting of a matrix of finned pipes, which preheat the moisture gas and is connected with one of the separator/filters;
- a heat recuperator consisting of a matrix of finned heat-pipes, one end of which is connected with the gas pre-heater;
- a refrigeration system to provide the cooling and heating working medium for the operations of the dehydrator;
- a moisture freezer consisting of a matrix of finned pipes, which is connected with the heat recuperator by one end, and is connected with the other one of the separator/filters by the other end; and pipelines for discharging the dehydrated gas.

In the apparatus described above, wherein using the warm, inlet gas to melt/dissociate the solid ice/hydrate deposits, so the moisture-laden raw gas is first heated to a sufficiently high temperature, in which the temperature rise Δt in the gas pre-heater should meet the following conditions:

$$\Delta t = t_{in} - t_{gas}, \text{ when } t_{in} > t_{gas},$$

$$\Delta t = 0, \text{ when } t_{in} \leq t_{gas}, \text{ and}$$

$$t_{in} = 2(t_{freeze} + \delta t) - t_{out},$$

where $\Delta t$ the temperature rise in the gas pre-heater, $t_{in}$ the temperature of the gas entering the recuperator, $t_{gas}$ the temperature of the raw gas, $t_{freeze}$ the temperature at which the moisture begins to freeze or the gas-hydrates begin to form, whichever is higher, $\delta t$ the design margin of the temperature above the freezing point, depending on the dissociation rate of the gas-hydrates; and $t_{out}$ the temperature of the gas flowing out from the recuperator In the apparatus described above, the heat recuperator and/or the moisture-freezer are made of irregular matrix with either a varying-pitch between the pipes in different rows, a varying-geometry (i.e., varying from a parallel to a staggered configuration) among different rows, or both a varying-pitch and a varying-geometry.

In the apparatus described above, the hot leg of the heat recuperator compromises three working regions: the regeneration (thawing) region, the transition region, and the moisture-freezing/hydrate-forming (freezing) region; and the moisture-freezing/thawing cycle within the recuperator can be accomplished by simply reversing the gas flow direction.

In the apparatus described above, the flow-shifting valves are integrated gas-driven valves, either rotary or reciprocating, each of which has a gas motor that is enclosed in a common housing with the valve.

In the apparatus described above, the refrigeration system is a small-Δp gas-driven refrigerant compressor that is driven by a gas motor in which the energy is provided by very large volume of gas flow with low gas pressure drop, i.e., less than 50% of the driving gas full pressure.

In the apparatus described above, the gas motor of said small-Δp gas-driven refrigerant compressor is a free-piston motor of which the two attached plungers may have different diameters to simultaneously compress two different refrigerants for performing a two-stage refrigeration to achieve very high dew-point depression when required.

The method and the apparatus provided by the present invention are universally applicable to the dehydration of all kind of gases, and, hence, can replace all the three major dehydration methods and dehydrators currently in the market, i.e., the solid desiccant absorption, the liquid desiccant absorption, and the refrigeration dehydration. In particular, it provides environmentally benign, self-powered, compact, and low-cost natural gas dehydrators for remote sites where no outside power supply is available.

BRIEF DESCRIPTION OF THE DRAWINGS

The above and other features and advantages of the present invention will now be further described in the following detailed descriptions in conjunction with the attached drawings in which.

DETAILED DESCRIPTION OF THE INVENTION

In a refrigeration dehydrator, the gas is deeply cooled with appropriate refrigerant supplied by a refrigeration system. The moisture contained in the gas is condensed into liquid water, and/or frozen into solid ice/hydrate before being removed. Two major difficulties may arise when cooling down the gas in an equipment of reasonable size, namely (1) how to retain relatively large quantity of the solid deposits in a compact heat exchanger without causing clogging? and (2) how to minimize the energy consumption for cooling down the gas to the required low dew-point temperature and keep the capital and operational costs to a competitive low level?

The present invention proposed an innovative approach in which an irregular matrix of finned pipes with an appropriate temperature gradient over the fin surfaces is adopted to simultaneously solve the above two problems. Details follow.

Figure 1A:
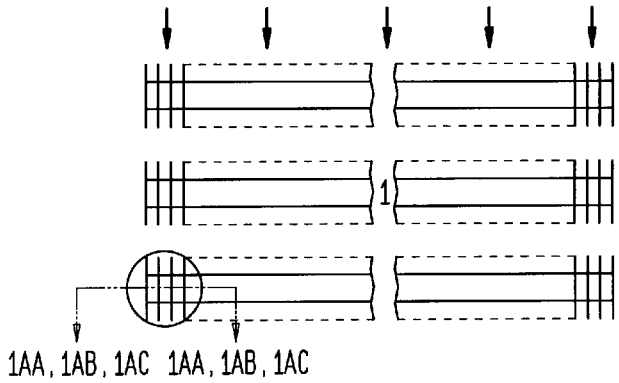
FIGS. 1A through 1E illustrate the innovative working principles of the present invention, namely, the non-uniform ice/hydrate deposits on the finned pipe surfaces, and the irregular matrix of finned pipes for increasing the solid deposits retentivity and extending the cycle period of the moisture freezing/thawing operations.
Figure 1A:
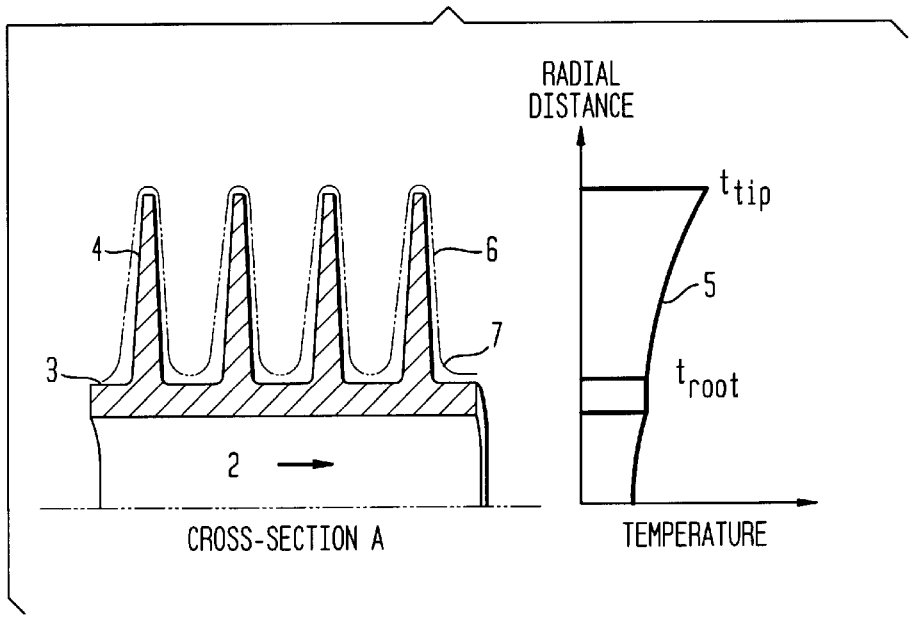
Figure 1A:
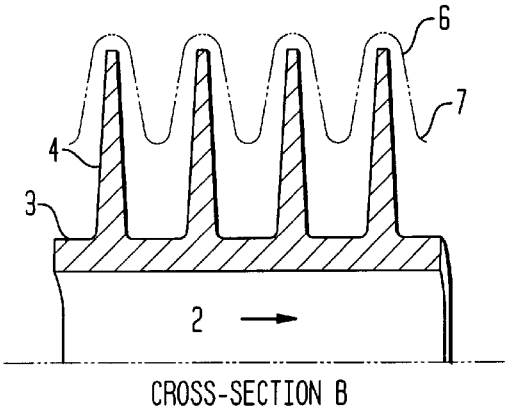
Figure 1A:
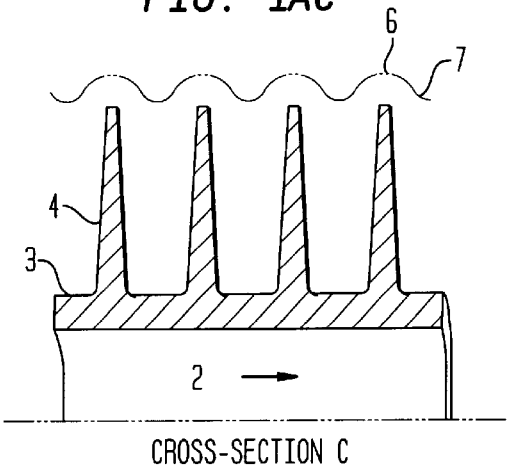

FIG. 1A shows the working principle of the non-uniform ice/hydrate formation over the surfaces of a finned pipe with a radial temperature gradient. The moisture-laden gas flows normally into a matrix of finned pipes 1. The direction of gas flow is shown with the arrows. Multiple open spaces between these pipes are provided to allow the gas flows freely under all conditions. The cross-sections of a small portion of the finned pipe are also shown in the figure. Cross-section A shows the initial phase of the ice/hydrate accumulation. Cross-section B shows the second phase of the ice/hydrate accumulation. Cross-section C shows the final phase of the ice/hydrate accumulation.

During the initial phase of the ice/hydrate accumulation, as shown in cross-section A, the solid deposit film just begins to grow. The cooling medium 2 flows inside the pipe. It absorbs heat from the pipe wall 3 and the fin 4. The heat flow resistance of the pipe/fin material causes a varying temperature as shown by curve 5 in the left-hand diagram. Because of the temperature at the fin tip, $t_{tip}$, is higher than the temperature at the fin root, $t_{root}$, the thickness 6 of the ice/hydrate deposit at the tip will be thinner than the thickness 7 of the ice/hydrate deposit at the root as shown by the dotted lines.

The second phase of the ice/hydrate accumulation is shown in cross-section B. The numbers represent the same items as those in cross-section A. The solid deposit now grows thicker and thicker. It fills up the inner portion of the fin gaps as shown by the dotted lines.

The ice/hydrate film will gradually fill up all the fin gaps, as shown in the cross-section C. Here the dotted lines show that the solid deposit has filled up all the fin gaps, or, in other words, the finned pipe has been frozen "solid."

Because relatively wide open spaces exist between the finned pipes, even if all the individual finned pipes in a particular row were frozen "solid," the gas could still flow freely around these frozen pipes and deposit its moisture on the finned pipes in the next rows. In addition, the ratio of the two portions of gas flowing through the open space and the fin gaps also varies inversely with the ratio of respective flow resistance. The thicker the ice/hydrate film accumulated on the fin surface, the higher flow resistance across the fin gaps. More moisture-laden gas will then bypasses the ice-laden finned pipes in the specific rows, and more moisture will freeze on the less ice-laden finned pipes in the next rows.

The numerous small gaps between the fins thus provide a huge reservoir for the ice/hydrate accumulation. No clogging is likely to happen even if all the finned pipes in the entire matrix were frozen "solid." In practice, the operation of the dehydrator will shift to an alternative cycle at some point between phase B and phase C and begin to thaw the solid deposits as appropriate. The clogging problem of the refrigeration dehydrator, therefore, is completely solved in the present invention.

Figure 1B:
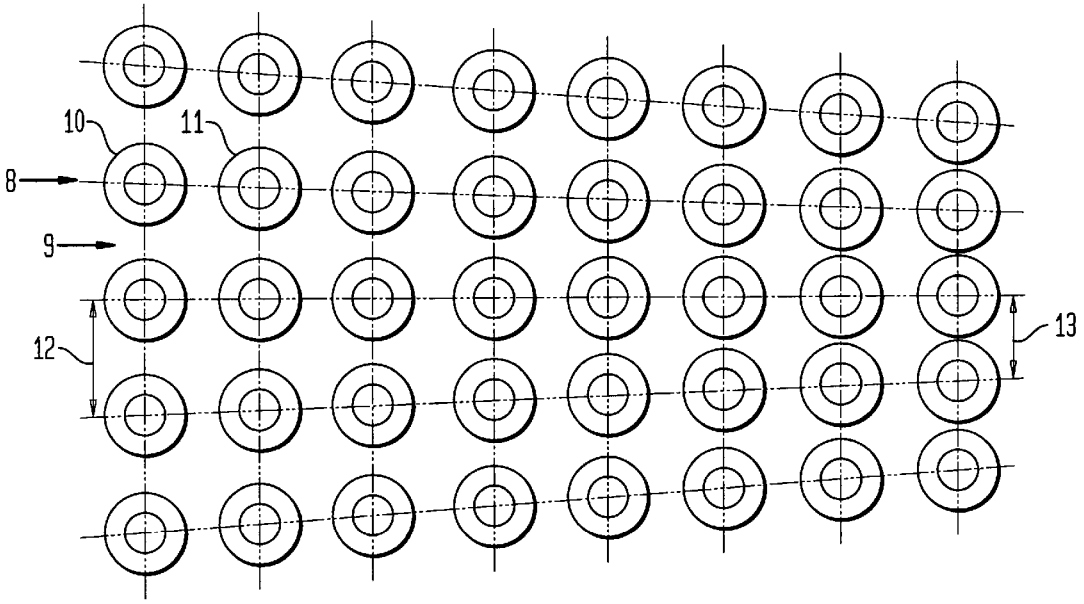

FIG. 1B shows the principle of the enhancement of the ice/hydrate retentivity in an irregular finned pipe matrix with a varying-pitch.

Unlike the ordinary heat exchange equipment, in which the pitch among the pipes in the matrix remains constant throughout, the present invention adopts a matrix of varying pitch specifically designed to accommodate the maximum amount of the ice/hydrate to extend the cycle period of operations. The moisture-laden gas flow direction is normal to the array of the finned pipes, as shown with the arrows 8 and 9. The arrow 8 indicates the portion of the gas flow impinging head-on to a finned pipe 10 in the first row. A significant fraction of the moisture contained in this portion of gas deposits as ice/hydrate on the heat transfer surfaces of the finned pipe 10. The arrow 9 indicates the portion of the gas flow through the open space and bypasses the finned pipes. The moisture contained in this portion of the gas will deposit as ice/hydrate on the surfaces of the pipes 11 in the second and the following rows.

The ratio of these two portions of gas flow depends on the ratio of the flow resistance through the open space to that of the fin gaps of the finned pipes in each row. By adjusting the pitch between the pipes in each row, the ratio may be varied. In this way, the distribution of the ice/hydrate deposits in different rows can be controlled. In FIG. 1B, it is shown that the larger pitch 12 in the front row decreases gradually to the smaller pitch 13 in the back row. The fraction of the moisture deposited on the pipes in the front row is less than that in the back row. Taken into consideration the moisture content is highest in the gas stream when flowing through the front row and the lowest through the back row, the net effect will make the ice/hydrate deposits more uniform across the entire matrix.

Figure 1C:
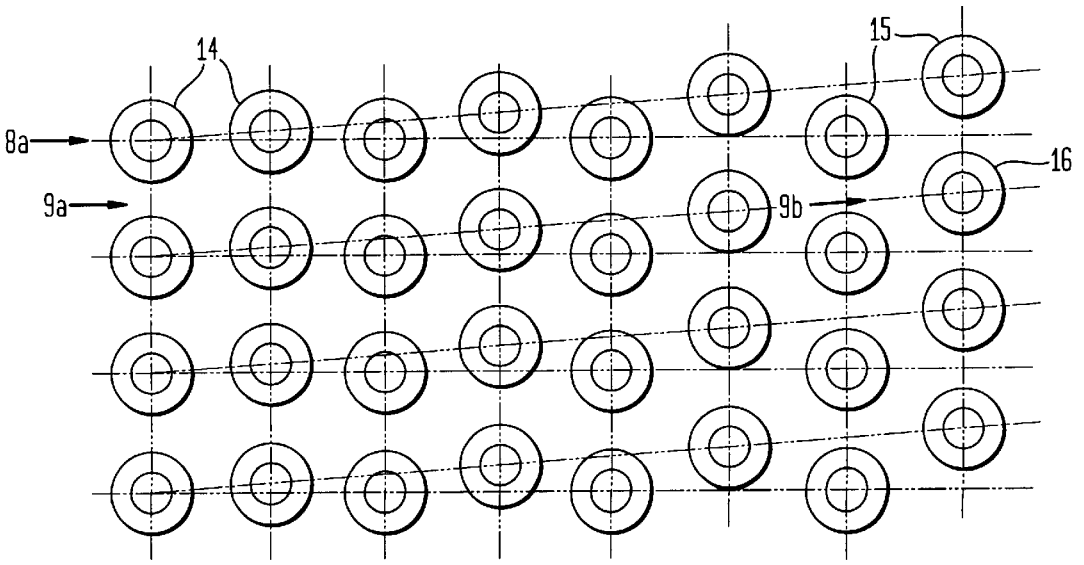

FIG. 1C shows the principle of the enhancement of ice/hydrate retentivity in an irregular finned pipe matrix with a varying-geometry.

Unlike the common regular matrix in which the geometry remains constant, either in-line or staggered, throughout the entire matrix, the present invention adopts a matrix with a varying-geometry. The geometry now gradually varies from the in-line configuration of the front rows 14 to the staggered configuration of the back rows 15. When the portion of the moisture-laden gas flows into the finned pipe 10*a* of the front row, as shown by the arrows 8*a*, a significant part of the moisture deposits as ice/hydrate on the finned pipe surface. The portion of the gas flow through the open space of the front row, as indicated with the arrow 9*a*, bypasses the finned pipes. The moisture contained in this portion of the gas flow will deposit as solid on the finned pipes 11 a of the second and the next rows.

However, when the gas flows into the back rows 15, the portions of the gas flow 9*b* through the open space will impinge head-on the finned pipe 16 of the last row and deposit the moisture on the finned pipe surface. The efficiency of moisture removal is thus much higher in the last rows as compared with that in the front rows. Taken into consideration the moisture content is highest in the gas stream when flowing through the front row and the lowest through the back row, the net effect will make the ice/hydrate deposits more uniform across the entire matrix.

The heat transfer coefficient in a staggered matrix is also larger than that in an in-line matrix. As a result, in the varying-geometry matrix the overall heat transfer coefficient is also better than that of the regular matrix with constant in-line geometry.

Figure 1D:
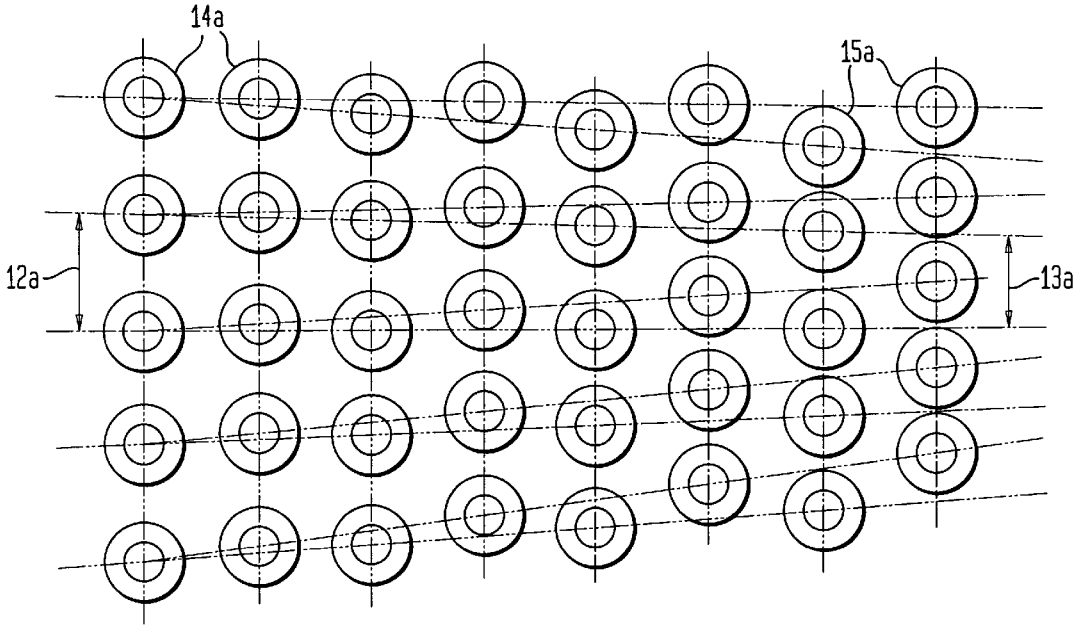

FIG. 1D is a combination of the irregular matrices shown in FIG. 1B and FIG. 1C. The pitch between the pipes gradually decreases from 12*a* to 13*a*, meanwhile the geometry of the matrix gradually changes from an in-line configuration in front rows 10*b* and 11*b* to a staggered configuration in the back rows 15*a*. The overall of ice/hydrate retentivity is highest in such a "double variation" matrix. Such an irregular matrix may accommodate more ice/hydrate deposits while keeping the flow path open without too much impairing the effectiveness of the heat transfer efficiency.

Figure 1E:
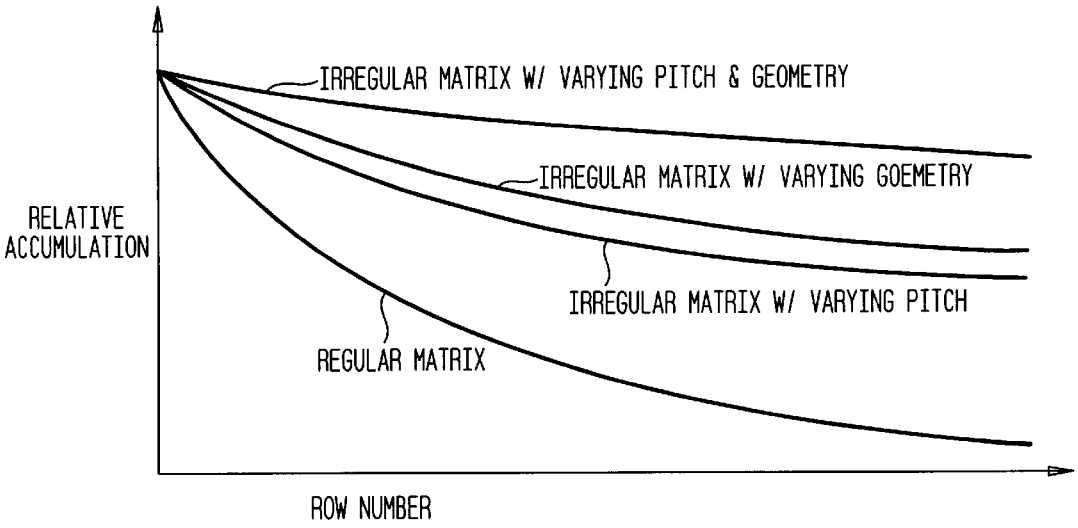

FIG. 1E is a schematic of the rates of ice/hydrate deposit along the gas flow path inside various finned pipe matrices. These curves are shown in four cases, i.e., (a): an irregular matrix with both varying-pitch and varying-geometry; (b): an irregular matrix with varying-geometry; (c): an irregular matrix with varying-pitch; and (d): a regular matrix. It is noted that, in a regular matrix, the rate of ice/hydrate deposit decreases sharply from the front to the back of the matrix. On the contrary, in the irregular matrices, the ice/hydrate deposit rates decrease much slower. The best result is given by the case of the irregular matrix with both varying-pitch and varying-geometry.

In summary, the combination of the working principles of the present invention will substantially increase the ice/hydrate retentivity of the finned pipe matrix. The clogging of the flow path is completely eliminated, and the cycle period of the operations will be extended an order of magnitude longer as compared with the dehydrators with confined elongate narrow conduits. This is one of the unique features of the present invention.

Figure 2A:
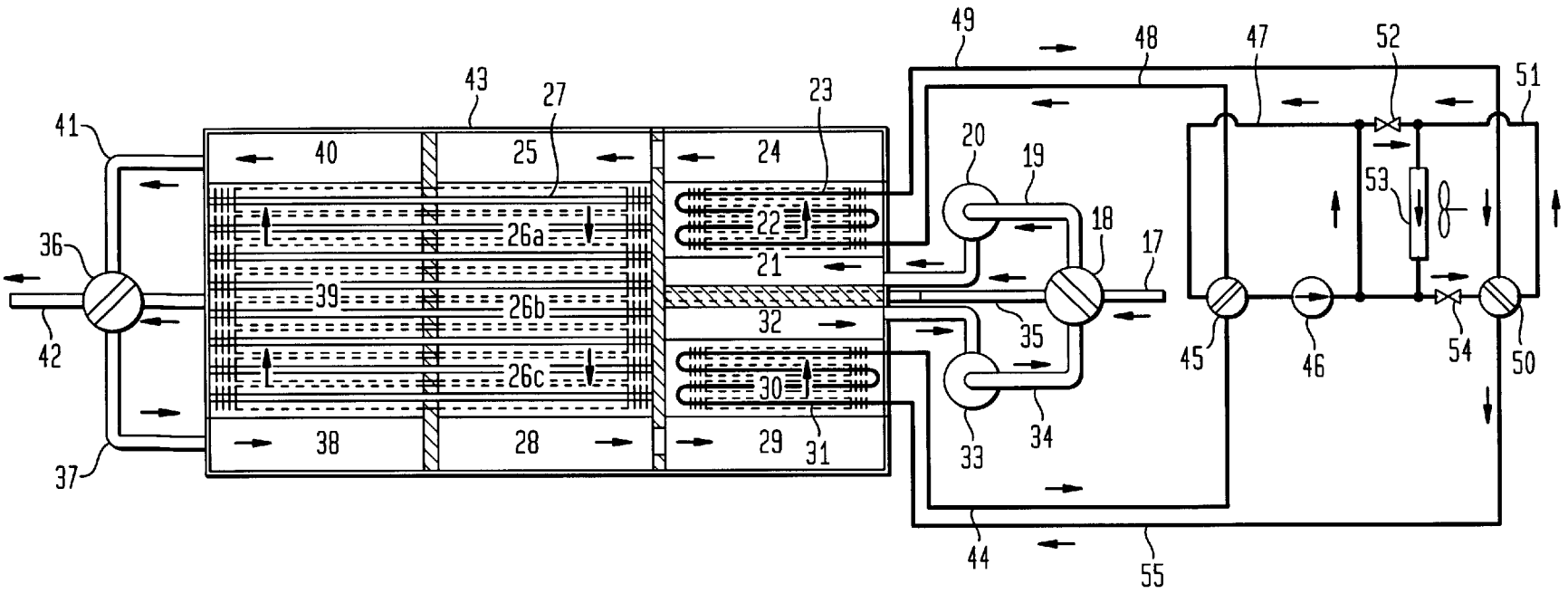
FIGS. 2A and 2B illustrate the configuration of the non-clogging, high dew-point depression gas dehydrator and the flow diagrams for two alternative operating cycles.
Figure 2B:
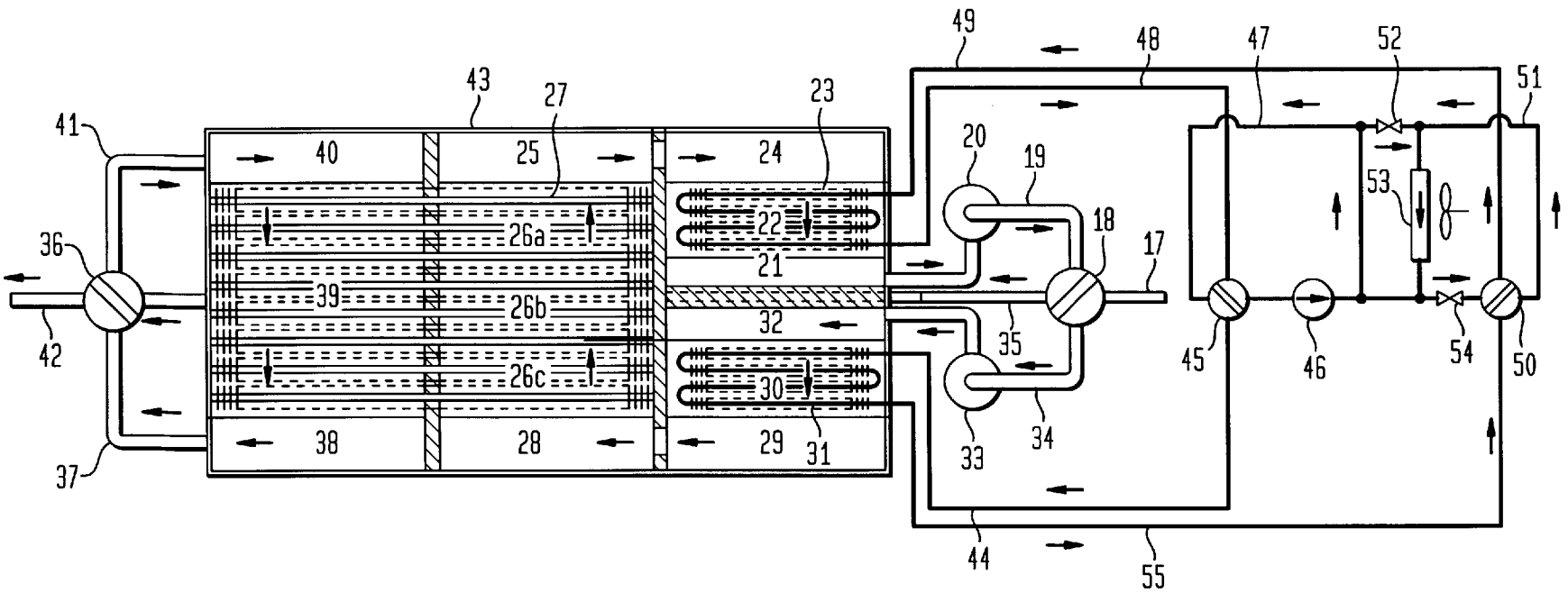

FIGS. 2A and 2B are, respectively, the detailed configuration and the flow diagrams of two alternative cycles of an operating non-clogging, high dew-point depression gas dehydrator. By simply reverse the gas flow direction inside the moisture freezer/gas pre-heaters and the recuperator between these two cycles, the moisture is continuously removed as liquid water and the gas is dehydrated to the required specifications.

As shown in FIGS. 2A and 2B, the non-clogging, high dew-point depression gas dehydrator has a symmetrical configuration as viewed from the top. It consists of two four-way flow-shifting valves 18 and 36, two ice/hydrate separators 20 and 33, two moisture freezer/gas pre-heaters 22 and 30, and one heat recuperator with a hot leg 26 and a cold leg 39.

FIG. 2A is a top-view of the dehydrator and the associated refrigeration system, showing the flow path of the gas during a specific cycle of the operation.

The warm, wet raw gas enters the dehydration system from the gas pipeline 17. The gas is directed into a four-way flow-shifting valve 18, and is distributed into the pipe 19 leading to the ice/hydrate separator/filter 20. The warm gas contacts the filter element and the inside wall of the separator, melts the ice/hydrate deposited during the last cycle. The water is drained through an automatic drainage valve not shown in the figure.

The warm gas at a temperature $t_{gas}$ is then directed into the plenum 21 of the gas pre-heater 22 (also served as moisture-freezer in the alternative cycle), which is heated with the hot compressed refrigerant vapor flowing inside the serpentine finned pipe 23. The gas temperature rise Δt in the pre-heater should meet the following conditions to guarantee the complete thawing of the ice/hydrate deposits accumulated during the previous cycle:

$$\Delta t = t_{in} - t_{gas}, \text{ when } t_{in} > t_{gas},$$

$$\Delta t = 0, \text{ when } t_{in} \leq t_{gas}, \text{ and}$$

$$t_{in} = 2(t_{freeze} + \delta t) - t_{out},$$

where

Δt the temperature rise in the gas pre-heater, $t_{in}$ the temperature of the gas entering the recuperator, $t_{gas}$ the temperature of the raw gas, $t_{freeze}$ the temperature at which the moisture begins to freeze or the gas-hydrates begin to form, whichever is higher, δt the design margin of the temperature above the freezing point, depending on the dissociation rate of the gas-hydrates; and $t_{out}$ the temperature of the gas flowing out from the recuperator The pre-heated gas at a temperature $t_{in}$ leave the plenum 24 of the pre-heater 20 and enters the plenum 25 of the hot leg of the heat recuperator 26, which consists of an irregular matrix of finned heat-pipes 27. The warm gas is being cooled down along its flow path by evaporating the heat transfer medium inside the finned heat-pipes 27. The heat recuperator pre-cools the down to a temperature as close to the required final dew-point as practical to minimize the energy consumption in the refrigeration system. The major portion (about 80–90%) of the moisture content of the inlet gas stream is removed in the recuperator. In this sense, the recuperator is the heart of this dehydrator.

The hot leg of the recuperator is roughly divided into three working regions 26*a*, 26*b*, and 26*c*, their respective boundaries varying during the operations according to the different gas compositions, temperatures and pressures.

The working region 26*a* is the regeneration, or the thawing region, in which the ice/hydrate deposits accumulated on the heat transfer surface during the previous cycle are being melted/dissociated by the warm gas. In the meantime, the gas is cooled down and a major portion of the moisture content is condensed as liquid water and removed. The gas leaves this region at a temperature of $t_{freeze}$+δt.

The working region 26*b* is the transition region, in which a part of the remaining moisture in the gas is condensed as liquid. No solid deposits appear in this region all the times of operations. The gas leaves this region at a temperature of $t_{freeze}$.

The working region 26*c* is the moisture-freezing/hydrates-formation, or the freezing region. The temperature of the bulk gas stream drops to and below the freezing point of water, or the gas-hydrates formation threshold temperature, if applicable. The solid deposits then accumulate on the chilled heat transfer surfaces. A small fraction of the solid particles may be entrained in the gas stream and flows out off the hot leg of the recuperator. The gas leaving the recuperator from the plenum 28 is precooled to a temperature $t_{out}$, which is designed to be as close as practical to the required dew-point (usually 15° F–30° F. higher) to minimize the energy consumption in the refrigeration system.

The pre-cooled gas enters the plenum 29 of the moisture freezer 30. The moisture freezer is cooled with the serpentine finned pipe 31 in which the refrigerant evaporates. The gas is further cooled down to the required dew-point when leaving the plenum 32. Most of the moisture deposits on the cooling surfaces of the finned pipes. A small fraction of the solid particles may form and be entrained in the gas stream and flows out off the moisture freezer 30.

The gas at the required dew-point temperature enters the ice/hydrate separator/filter 33. The ice/hydrate particles are retained in the separator/filter. The gas is then dehydrated to the required specification. The dry, cold gas then flows through the pipe 34 into the flow-shifting valve 18. The gas is directed to a pipe 35 and flows into the four-way flow-shifting valve 36 at the other end of the dehydration assembly. The gas is directed into the pipe 37 and enters the plenum 38 of the cold leg of the recuperator 39. The dry, cold gas absorbs from the heat-pipe the latent heat of the working medium condensed inside the heat-pipes. The gas temperature rises before it leaves the plenum 40 of the cold leg of the recuperator. The dry, warm gas then re-enters the flow-shifting valve 36 via the pipe 41, and is discharged into the gas outlet pipeline 42.

The entire dehydration equipment is enclosed in a single pressure vessel 43 to facilitate the containing of high gas pressure and to reduce the manufacturing cost. All the moisture removed from the gas eventually transforms into liquid water and is discharged though a set of automatic drainage valves not shown in the figure.

The associated refrigeration system is also shown in FIG. 2A. The refrigerant vapor leaving the moisture freezer flows through pipe 44 to the four-way flow-shifting valve 45. The vapor is directed to the compressor 46. The temperature of the vapor rises when leaving the compressor. A part of the hot, compressed vapor passes through the pipe 47 to the flow-shifting valve 45, and is then directed through the pipe 48 into the serpentine pipe 23 of gas pre-heater 22. This portion of the hot, compressed vapor leaves the pre-heater via the pipe 49, and is directed into another four-way flow-shifting valve 50. The vapor is then directed into the pipe 51, where it joins the rest of the hot vapor flowing through the by-pass valve 52. All refrigerant vapor is then condensed into liquid when flowing through the radiator 53.

The refrigerant liquid then passes through the expansion valve 54 and enters the flow-shifting valve 50 under reduced pressure. The depressurized liquid refrigerant flows to the moisture-freezer 30 via pipe 55.

Before the finned pipes in either the moisture freezer 30 or the moisture-freezing region 26*c* are frozen solid, the dehydrator is shifted to the next working cycle. The valve positions of all the four flow-shifting valves 18, 36, 45, and 50 are turned 90 degrees, and the gas flow is reversed.

FIG. 2B is another top-view of the dehydrator and the associated refrigeration system, showing the flow path of the gas during the alternative cycle of the operation immediately after the cycle described in FIG. 2A. As mentioned above, the gas flow direction inside the dehydrator is reversed in this cycle. Since the same equipment is used, the numbers of the equipment and components remain the same as those in FIG. 2A.

The warm, wet raw gas enters the dehydration system from the gas pipeline 17. The gas is directed into a four-way flow-shifting valve 18, and is now distributed into the pipe 34 leading to the ice/hydrate separator/filter 33. The warm gas contacts the filter element and the inside wall of the separator, melts the ice/hydrate that deposited during the last cycle. The water is drained through an automatic drainage valve not shown in the figure.

The warm gas at a temperature $t_{gas}$ is then directed into the plenum 32 of the gas-pre-heater 30 (also served as the moisture-freezer in the alternative cycle), which is heated with the hot, compressed refrigerant vapor flowing in the serpentine finned pipe 31. The gas temperature rise $\Delta t$ in the pre-heater should meet the same conditions as described in FIG. 2A to guarantee the complete thawing of the ice/hydrate deposited during the previous cycle The pre-heated gas at a temperature $t_{in}$ leave the plenum 29 of the pre-heater 30 and enters the plenum 28 of the hot leg of the heat recuperator 26, which consists of an irregular matrix of heat-pipes 27. The warm gas is being cooled down along its flow path by evaporating the heat transfer medium inside the finned heat-pipes 27. The heat recuperator pre-cools the down to a temperature as close to the required final dew-point as practical to minimize the energy consumption in the refrigeration system. The major portion (about 80–90%) of the moisture content of the inlet gas stream is removed in the recuperator. In this sense, the recuperator is the heart of this dehydrator.

The hot leg of the recuperator is roughly divided into three working regions 26*a*, 26*b*, and 26*c*, their respective functions have been changed due to the reversed flow of the gas.

Because the gas flow is now inversed, the working region 26*c* becomes the regeneration region, in which the ice/hydrate deposits accumulated on the heat transfer surface during the previous cycle are being melted/dissociated by the warm gas. In the meantime, the gas is cooled down and a major portion of the moisture content is condensed as liquid water and removed. The gas leaves this region at a temperature of $t_{freeze}+\delta t$.

The working region 26*b* is the transition region, in which a part of the remaining moisture in the gas is condensed as liquid. No solid deposits appear in this region all the times of operations. The gas leaves this region at a temperature of $t_{freeze}$.

The working region 26*a* is now the freezing region. The temperature of the bulk gas stream drops to and below the freezing point of water, or the gas-hydrates formation threshold temperature, if applicable. The solid deposits then accumulate on the chilled heat transfer surfaces. A small fraction of the solid particles may be entrained in the gas stream and flows out off the hot leg of the recuperator. The gas leaving the recuperator from the plenum 25 is precooled to a temperature $t_{out}$, which is designed to be as close as practical to the required dew-point (usually 15° F.–30° F. higher) to minimize the energy consumption in the refrigeration system.

The pre-cooled gas enters the plenum 24 of the moisture freezer 22. The freezer is cooled with the serpentine finned pipe 23 in which the refrigerant evaporates. The gas is further cooled down to the required dew-point when leaving the plenum 21. Most of the moisture deposits on the cooling surfaces of the finned pipes. A small fraction of the solid particles may be entrained in the gas stream and flows out off the moisture freezer 22.

The gas at the required dew-point temperature $t_{freeze}$ then enters the ice/hydrate separator/filter 20. The ice/hydrate particles are retained in the separator/filter. The dry, cold gas then flows through the pipe 19 into the flow-shifting valve 18. The gas is directed to a pipe 35 through which the gas flows to the four-way flow-shifting valve 36 at the other end of the dehydration assembly. The dry, cold gas is directed into the pipe 41 and enters the plenum 40 of the cold leg of the recuperator 39. The dry, cold gas absorbs heat from the heat-pipe by condensing the working medium vapor inside the heat-pipes. The gas temperature rises before it leaves the plenum 38 of the cold leg of the recuperator. The warm, dry gas then re-enters the flow-shifting valve 36 via the pipe 37, and is directed to the gas outlet pipeline 42.

The entire dehydration equipment is enclosed in a single pressure vessel 43 to facilitate the containing of high gas pressure and to reduce the manufacturing cost. All the moisture removed from the gas eventually transforms into liquid water and is discharged though a set of automatic drainage valves not shown in the figure.

The associated refrigeration system is also shown in FIG. 2B. The refrigerant vapor leaving the moisture freezer flows through pipe 48 to the four-way flow-shifting valve 45. The vapor is directed to the compressor 46. The temperature of the vapor rises when leaving the compressor. A portion of the hot, compressed vapor passes through the pipe 47 to the flow-shifting valve 45, and is then directed through the pipe 44 into the serpentine pipe 31 of the gas pre-heater 30. This portion of the hot, compressed vapor leaves the pre-heater via the pipe 55, which directs the vapor into another four-way flow-shifting valve 50. The valve 50 directs the vapor into the pipe 51, where the vapor joins the rest of the hot vapor that flows through the by-pass valve 52. All vapor is condensed into liquid when flowing through the radiator 53.

The refrigerant liquid then passes through the expansion valve 54 and enters the flow-shifting valve 50 under reduced pressure. The depressurized liquid refrigerant flows to moisture freezer 22 via pipe 49.

Figure 3:
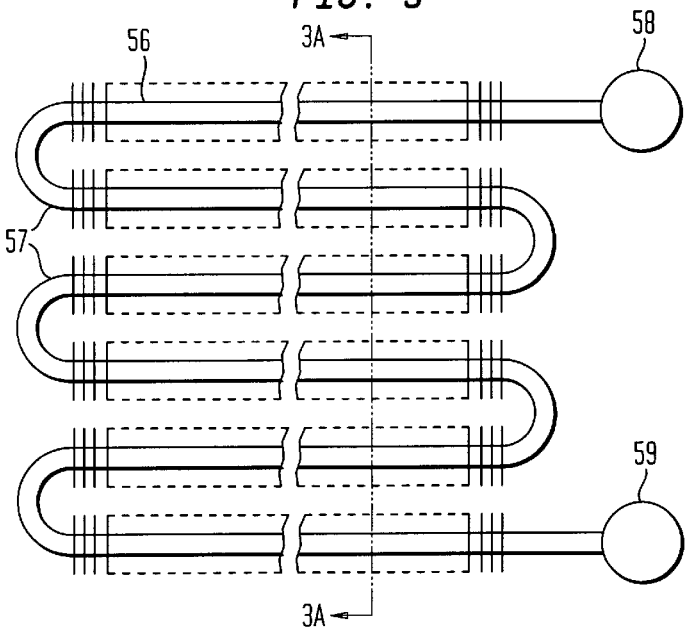
FIG. 3 illustrates the detailed structure of the moisture freezer/gas pre-heater with an irregular matrix of finned pipes.
Figure 3A:
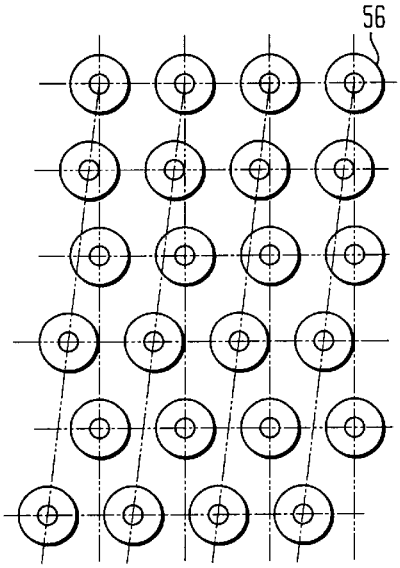

FIG. 3 illustrates the detailed structure of the moisture freezer/gas pre-heater with an irregular finned pipe matrix. One of the features of the present invention is the dual function of this equipment. It consists of a serpentine pipe 56 made of multiple finned pipes arranged in an irregular matrix. These pipes are interconnected at both ends by the U-pipe sections 57 into groups. The open ends of each group of pipes are welded, respectively, to the inlet and outlet headers 58 and 59.

When this equipment is used as a moisture freezer, the refrigerant liquid passes through the expansion valve (refer to the valve 54 in FIG. 2A) and enters the serpentine pipe 56. The depressurized liquid refrigerant evaporates inside the pipe and cools the pipe surfaces to a temperature below the freezing point of the moisture or the gas-hydrate formation threshold temperature. The gas stream is cooled down and a major portion of the moisture content of the gas freezes on the pipe surface.

When the same equipment is used as a gas pre-heater, the hot compressed refrigerant vapor enters the serpentine pipe 56. The hot refrigerant vapor heats up the fin surfaces to a temperature above the ice/hydrate melting/dissociation temperature. The solid ice/hydrate deposits in on the heat transfer surfaces are then melted/dissociated.

Figure 4:
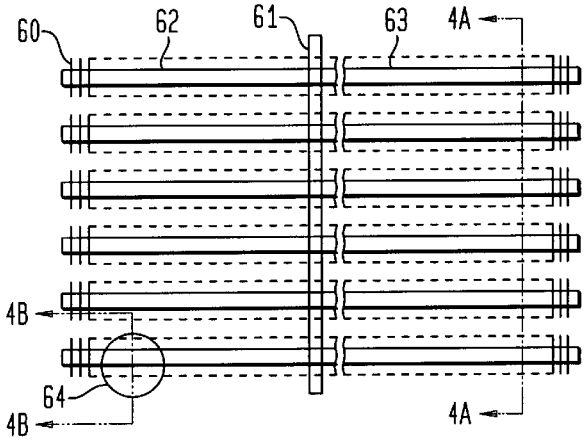
FIG. 4 illustrates the detailed structure of the heat recuperator with an irregular matrix of finned heat-pipes.
Figure 4A:
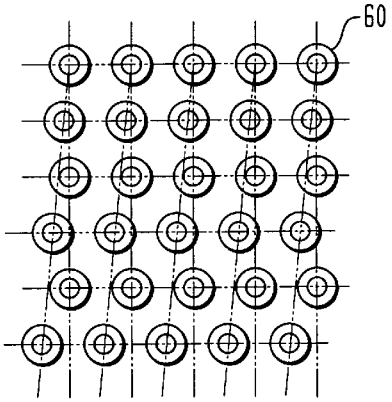
Figure 4B:
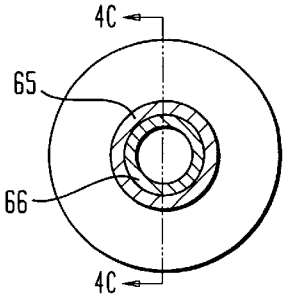
Figure 4C:
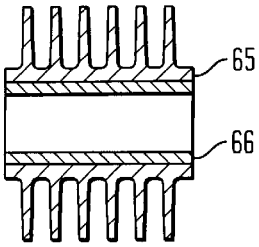

FIG. 4 illustrates the structure of the heat recuperator with an irregular heat-pipe matrix. The recuperator is the heart of the present gas dehydrator. It takes out most of the moisture from the wet gas, and save a substantial fraction of the energy that would be otherwise consumed for cooling down the gas to the required dew-point. The recuperator consists of a matrix of multiple individual finned heat-pipes 60, which are divided by a baffle 61 into two sections, i.e., the hot leg 62 and the cold leg 63. A section of a portion 64 of one heat-pipe is enlarged in FIG. 4. Inside the finned pipe 65, there is a sleeve of wick 66 that transports the condensed liquid working medium from the cold leg 63 to the hot leg 62.

The preheated wet gas flows outside the hot leg 62 of the heat-pipes. The liquid working medium, contained in the wick 66 inside the heat-pipes, evaporates and absorbs the heat from the gas. The gas temperature drops to a level as close to the required dew-point as practical, usually about 15°–30° F. above the required dew-point. The vapor of the working medium flows inside the individual heat-pipes to the cold leg 63 and is condensed on the inside surface of the wick 66 there. The latent heat of condensation heats up the cold dried gas flowing outside the heat-pipes. The heat-pipe recuperator is so efficient that, under most cases, it saves (or recovers) about 80–90% of the energy that might otherwise be required to remove the same amount of moisture from the gas by simple refrigeration process without the heat recuperator.

Figure 5A:
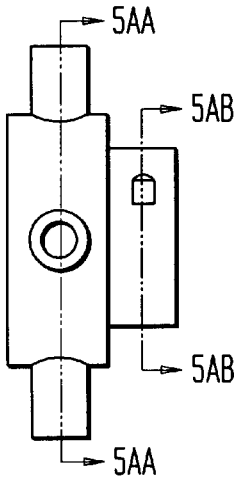
FIGS. 5A and 5B illustrate two configurations of the integrated gas-driven flow-shifting valve.
Figure 5A:
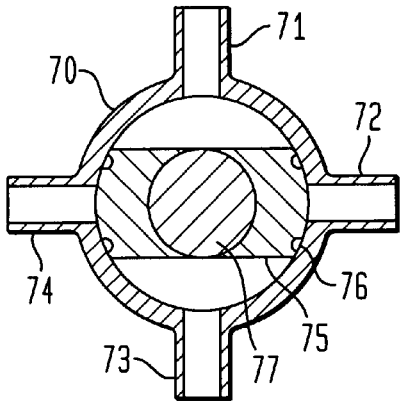
Figure 5A:
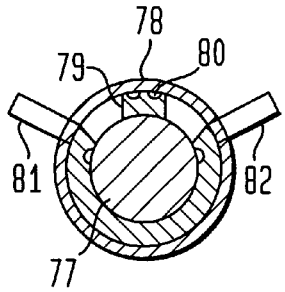
Figure 5B:
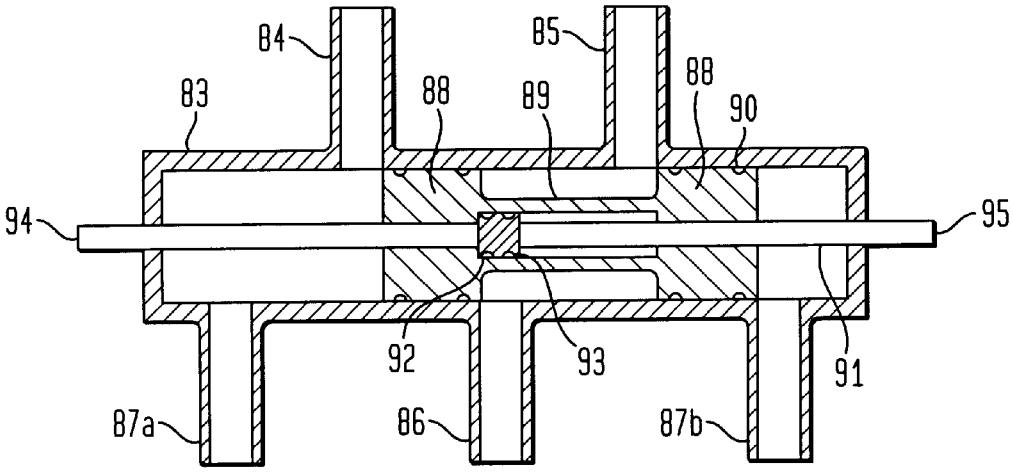

FIGS. 5A and 5B illustrates the various configurations of the integrated gas-driven flow-shifting valve. Such a valve is particularly useful in natural gas dehydrators at remote sites where no outside grid electricity supply is available. The unique integrated configuration of the present invention makes such a valve very compact, easy to manufacture, and low cost.

FIG. 5A shows a rotary type flow-shifting valve 67. It consists of a valve body 68 and a rotary gas motor 69 for driving the valve.

The cross-section of the valve body 68 is shown in FIG. 5A. The valve cylinder 70 has four outlets 71, 72, 73 and 74. A blade 75 that rotates inside the cylinder has several gas seals 76. The blade 75 is attached to an axle 77. Because the pressure differences between the two gas streams being shifted is rather small, the gas seals are easy to manufacture. A low-expansion, low-heat conductivity material should be used to construct the valve body 68 and the blade 75.

The cross-section of the rotary gas motor 69 is also shown in FIG. 5A. Inside the motor casing 78, there is a small blade 79 with several gas seals 80 mounted on to the axle 77. The motor is actuated by alternatively supplying a small amount of dried natural gas to the opposite sides of the blade via gas pipelines 81 and 82. The pressure of the driving-gas turns the blade 75 of the valve 68 and shifts the gas flow between the pair of gas inlet ports 71/73 and outlet ports 72/74. The supply and discharge of the driving gas is controlled by a timing-devise not shown in the figure.

FIG. 5B shows an alternative, free-piston type flow-shifting valve. The valve body 83 is a cylinder on which four inlet/outlet ports, 84, 85, 86, and 87 (consisting of 87A and 87B), are mounted. A twin-head free-piston 88 is rigidly connected in tandem with a hollow axle 89. Multiple gas seals 90 are mounted to the free-piston. Inside the hollow axle 89, there is a small power piston 92 with gas seals 93 fixed on a smaller axle 91. Two gas pipelines 94 and 95 supply and discharge the driving gas alternatively to the opposite sides of the small power piston 92. The twin-head free-piston is thus pushed to slide along the small axle. The motion of the twin-head free-piston shifts the gas flow between the pair of pipes 84/85 and another pair of pipes 86/87. The free-piston type valve can stand higher gas pressure and temperature difference than the rotary type, but the size is larger.

Figure 6:
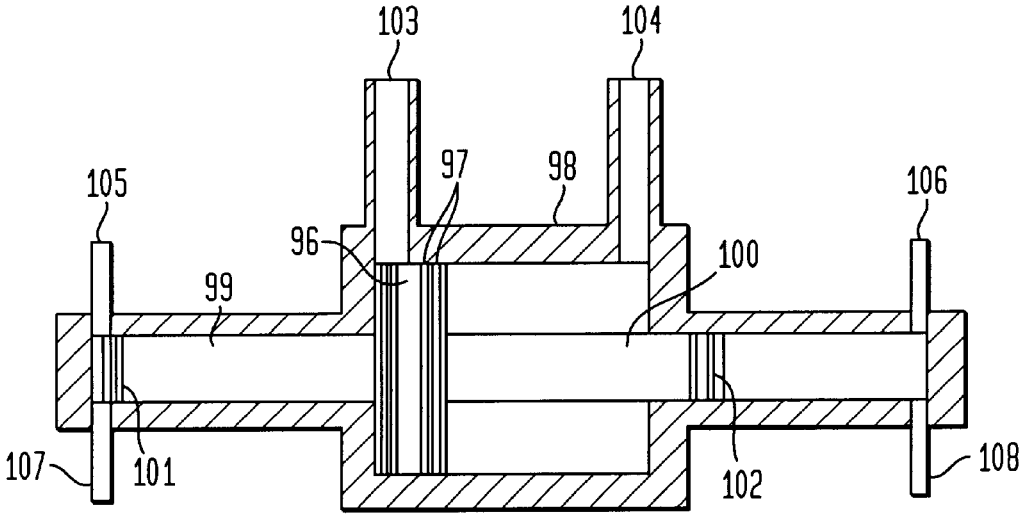
FIG. 6 illustrates a free-piston small-Δp (i.e., small difference in pressure) gas-driven refrigerant compressor that can be used for accomplishing either one-stage or two-stage refrigeration to provide sufficiently low temperature for high dew-point depression.

FIG. 6 illustrates the configurations of the free-piston small-Δp gas-driven refrigerant compressor.

The refrigerant compressor is a key component in the present gas dehydrator system. An innovative small-Δp gas-driven refrigerant compressor is proposed not only to provide a substitute to the electricity power supply at remote sites, but also to further reduce the capital and operating cost of the dehydrator. In the present invention, the full flow of the gas through the dehydrator is used as the driving gas.

In ordinary gas motors, full pressure of the driving gas is utilized due to efficiency and economic considerations. For natural gas dehydrators, it is not allowed to fully depressurize even a fraction of the driving gas and discharge it into atmosphere. The gas motor should be on-line equipment, i.e., the exhaust gas should retain sufficiently high pressure so that it can be re-send into the gas pipeline. As a result, only a very small gas pressure drop is allowed. In particular, for low-pressure gas wells, extremely small-Δp is available. Given the huge amount of the driving gas flow rate associated with the very small pressure drop, the size and cost of the gas motor are the major concerns of the present invention.

For a low-pressure gas well, the allowable low gas pressure difference across the gas motor would be less than 10% of the driving gas full pressure, depending on the initial gas conditions. Different configurations of such a small-Δp gas-driven refrigerant compressor have been studied under different gas conditions. Theoretically, a gas turbine will be the first choice under such conditions. However, because of the great variety of the kinds and the physical conditions of natural and industrial gases, it is difficult to always identify an appropriate commercial product in the market. When customized equipment has to be built, a simple, easy-to-built, and non-expensive design will be indispensable. One example follows.

FIG. 6 illustrates a free-piston type small-Δp gas-driven refrigerant compressor that can perform either one-stage or two-stage refrigeration to provide sufficiently low temperature for high dew-point depression. It consists of a free-piston 96 with multiple piston rings 97 that sliding within the cylinder 98. The free-piston is rigidly connected to two small plungers 99 and 100 with multiple gas seals 101 and 102. The driving gas is fed and discharged alternatively through the gas pipelines 103 and 104 to move the piston 97. The magnitude of Δp between the fed and discharged gas depends on the condition of the gas exiting the dehydrator and the requirement on the gas transport pipeline. The refrigerant compressed alternatively by two plungers 99 and 100 flows in and out through pipes 105 and 108. All the inlet and outlet valves, not shown in the figure, are also operated by gas pressure.

An outstanding merit of the free-piston type refrigerant compressor is the capability of accomplishing two-stage refrigeration with two different refrigerants in single equipment to obtain extremely low temperature. In this case, the two plungers are designed with different diameters to compress different refrigerants simultaneously.

Because the free-piston and the associated plungers are so simple and light-weighted, very high frequency cycle of piston motion is feasible. The size of the gas motor is rather small. As an example, for a 10 MMscfd natural gas well at a gas pressure of 200 psig and temperature of 100° F., the gas motor cylinder diameter is only 6 inches, and the piston stroke is about 4.423 inches when running at 4,000 cycles per minute. The manufacture of the free-piston compressor is within the state-of-the-art and the cost is low. Such a compact free-piston compressor may also find applications even in other refrigeration duties.

In summary, the present invention provides an innovative method and a universally applicable apparatus that remove the moisture from the gas to a very low dew-point. It has the potential of competing with and replacing the current refrigerators in the entire gas dehydration market. No hazardous emission will be discharged to the atmosphere.

Having described the present invention and preferable embodiments thereof, it will be recognized that numerous variations, substitutions and additions may be made to the present invention by those ordinary skills without departing from the spirit and scope of the appended claims.

What is claimed is:

1. A gas dehydrator for continuously removing moisture from a moisture-laden gas compromising:

a couple of flow-shifting valves connected with a gas inlet pipeline, which periodically reverse the gas flow direction to perform the functions of alternative moisture-freezing/thawing for the continuous removal of moisture from the gas;

a couple of separator/filters that take out the entrained solid ice/hydrate particles from the cooled gas stream, one end of each is connected with the flow-shifting valves through pipeline;

a gas pre-heater consisting of a matrix of finned pipes, which preheat the moisture gas and is connected with one of the separator/filters;

a heat recuperator consisting of a matrix of finned heat-pipes, one end of which is connected with the gas pre-heater;

a refrigeration system to provide the cooling and heating working medium for the operations of the dehydrator;

a moisture freezer consisting of a matrix of finned pipes, which is connected with the heat recuperator by one end, and is connected with the other one of the separator/filters by the other end; and pipelines for discharging the dehydrated gas.

2. A gas dehydrator of claim 1 wherein using the warm, inlet gas to melt/dissociate the solid ice/hydrate deposits, so the moisture-laden raw gas is first heated to a sufficiently high temperature, the temperature rise Δt in the gas pre-heater should meet the following conditions:

$$\Delta t = t_{in} - t_{gas}, \text{ when } t_{in} > t_{gas},$$

$$\Delta t = 0, \text{ when } t_{in} \leq t_{gas}, \text{ and}$$

$$t_{in} = 2(t_{freeze} + \delta t) - t_{out},$$

where

Δt the temperature rise in the gas-pre-heater, $t_{in}$ the temperature of the gas entering the recuperator, $t_{gas}$ the temperature of the raw gas, $t_{freeze}$ the temperature at which the moisture begins to freeze or the gas-hydrates begin to form, whichever is higher, δt the design margin of the temperature above the freezing point, depending on the dissociation rate of the gas-hydrates, and $t_{out}$ the temperature of the gas flowing out from the recuperator.

3. A gas dehydrator of claim 1 wherein the heat recuperator and/or the moisture-freezer are made of irregular matrix with either a varying-pitch between the pipes in different rows, a varying-geometry (i.e., varying from a parallel to a staggered configuration) among different rows, or both a varying-pitch and a varying-geometry.

4. A gas dehydrator of claims 1 wherein the hot leg of the heat recuperator compromises three working regions: the regeneration/thawing region, the transition region, and the moisture-freezing/hydrate-forming/freezing region; and the moisture-freezing/thawing cycle within the recuperator can be accomplished by simply reversing the gas flow direction.

5. A gas dehydrator of claim 1 wherein the flow-shifting valves arc integrated gas-driven valves, either rotary or reciprocating, each of which has a gas motor that is enclosed in a common housing with the valve.

6. A gas dehydrator of claim 1 wherein the refrigeration system is a small-Δp gas-driven refrigerant compressor that is driven by a gas motor in which the energy is provided by very large volume of gas flow with low gas pressure drop, i.e., less than 50% of the driving gas full pressure.

7. A gas dehydrator of claim 6 wherein the gas motor of said small-Δp gas-driven refrigerant compressor is a free-piston motor of which the two attached plungers may have different diameters to simultaneously compress two different refrigerants for performing a two-stage refrigeration to achieve very high dew-point depression when required.

8. The gas dehydrator of claim 1 wherein the finned pipes of the heat recuperator comprise fin surfaces wherein the temperature distribution over the fin surfaces varies so that the thickness of the ice/hydrate deposit film on the surfaces tapers from the root towards the tip.

9. The apparatus of claim 8 wherein the finned pipes of the moisture freezer comprises fin surfaces wherein the temperature distribution of the finned surfaces vary so that the thickness of the ice/hydrate deposit film on the surfaces tapers from the root towards the tip.

10. The apparatus of claim 1 wherein the finned pipes of the moisture freezer comprises fin surfaces wherein the temperature distribution of the fin surfaces vary so that the thickness of the ice/hydrate deposit film on the surfaces tapers from the root towards the tip.

* * * * *